US008598974B1

(12) United States Patent
Hsieh

(10) Patent No.: US 8,598,974 B1
(45) Date of Patent: Dec. 3, 2013

(54) COIL FILTER

(75) Inventor: Ming Yen Hsieh, Taoyuan Hsien (TW)

(73) Assignee: Tai-Tech Advanced Electronics Co., Ltd., Youth Industrial District Yangmei, Taoyuan (TW)

( * ) Notice: Subject to any disclaimer, the term of this patent is extended or adjusted under 35 U.S.C. 154(b) by 0 days.

(21) Appl. No.: 13/554,030

(22) Filed: Jul. 20, 2012

(51) Int. Cl.
*H01F 17/04* (2006.01)
*H01F 27/28* (2006.01)

(52) U.S. Cl.
USPC ..... 336/221; 336/232

(58) Field of Classification Search
USPC ..... 336/221, 232
See application file for complete search history.

(56) References Cited

U.S. PATENT DOCUMENTS 6,583,697 B2 * 6/2003 Koyama et al. ..... 336/83
6,691,399 B1 * 2/2004 Hayashi et al. ..... 29/605
6,917,273 B2 7/2005 Okamoto
7,474,193 B2 1/2009 Na et al.
2012/0153748 A1 * 6/2012 Wauke ..... 310/25

* cited by examiner

*Primary Examiner* — Alexander Talpalatski
*Assistant Examiner* — Joselito Baisa
(74) *Attorney, Agent, or Firm* — Charles E. Baxley

(57) ABSTRACT

A coil filter includes a core member having two end members extended from two end portions, the left end member includes a front protrusion, a rear protrusion, and a middle protrusion extended upwardly beyond the core member, the front protrusion includes a width (W) greater than that of the rear protrusion and the middle protrusion, the second end member includes a rear projection, a front projection, and a middle projection extended upwardly beyond the core member, the rear projection includes a width (T) greater than the width (t) of the front projection and the middle projection, and a coil member wound onto the core member and disposed between the end members without wasting the spaces of the core member.

19 Claims, 5 Drawing Sheets

COIL FILTER

BACKGROUND OF THE INVENTION

1. Field of the Invention

The present invention relates to a coil filter, and more particularly to a coil filter including a core member having an improved structure or configuration for allowing the windings of the coil member to be suitably wound and engaged onto the core member without wasting the spaces of the core member.

2. Description of the Prior Art

Typical coil filters comprise a core member, and a coil having one or more windings to be wound and engaged onto the core member, and the windings each include two ends or terminals to be extended out of the core member and attached or mounted or secured or anchored or retained to the core member with latches or fasteners or welders, or the like, and to be electrically connected or coupled to the other electrical facilities.

For example, U.S. Pat. No. 6,917,273 to Okamoto, and U.S. Pat. No. 7,474,193 to Na et al. disclose two of the typical coil filters each also comprising a core member having a predetermined size or shape or structure or configuration, and a coil having one or more winding members to be wound and engaged onto the core member.

However, the predetermined size or shape or structure or configuration of the core member may determine and affect the winding or engaging of the winding members onto the core member, and a portion or a space of the core member will be wasted and may not be wound and engaged with the winding members.

The present invention has arisen to mitigate and/or obviate the afore-described disadvantages of the conventional core members for the coil filters.

SUMMARY OF THE INVENTION

The primary objective of the present invention is to provide a coil filter including a core member having an improved structure or configuration for allowing the windings of the coil member to be suitably wound and engaged onto the core member without wasting the spaces of the core member.

In accordance with one aspect of the invention, there is provided a coil filter comprising a core member including a front portion, a rear portion, an upper portion, a bottom portion, a first end portion, and a second end portion, and including a first end member extended from the first end portion of the core member, and including a second end member extended from the second end portion of the core member, the first end member including a front protrusion located at the front portion of the core member, a rear protrusion located at the rear portion of the core member, and at least one middle protrusion extended upwardly beyond the core member and located between the front and the rear protrusions for forming two notches between the front and the rear and the at least one middle protrusions, the front protrusion including a width (W) greater than that of the rear protrusion and the at least one middle protrusion, the second end member including a rear projection located at the rear portion of the core member, a front projection located at the front portion of the core member, and at least one middle projection extended upwardly beyond the core member and located between the front and the rear projections for forming two spaces between the front and the rear and the at least one middle projections, the rear projection including a width (T) greater than the width (t) of the front projection and the middle projection, and a coil member wound and engaged and secured onto the core member and disposed and arranged between the first and the second end members without wasting the spaces of the core member, and the coil member includes terminals attached or mounted or secured to the protrusions and the projections.

The coil member includes a first winding wound and engaged onto the core member, and the first winding includes two terminals engaged onto the front protrusion and the front projection respectively. The terminals of the first winding are secured to the front protrusion and the front projection with fasteners or welders respectively.

The coil member includes a second winding wound and engaged onto the core member, and the second winding includes two terminals engaged onto the rear protrusion and the rear projection respectively. The terminals of the second winding are secured to the rear protrusion and the rear projection with welders respectively.

The coil member includes at least one third winding wound and engaged onto the core member and disposed between the first and the second windings, the at least one third winding includes two terminals engaged onto the at least one middle protrusion and the at least one middle projection respectively. The terminals of the at least one third winding are secured to the at least one middle protrusion and the at least one middle projection with welders respectively.

The first end member is extended upwardly and downwardly and forwardly and rearwardly beyond the core member. The front and the rear and the at least one middle protrusions are preferably extended upwardly beyond the core member and flush with each other.

The front protrusion is extended forwardly beyond the front portion of the core member, and the rear protrusion is extended rearwardly beyond the rear portion of the core member. The middle protrusion includes a width (w) no less than that of the rear protrusion.

The front and the rear and the at least one middle protrusions include a depth (D) equal to each other. The notches between the front and the rear and the at least one middle protrusions include a gap distance (G) equal to each other.

The second end member is extended upwardly and downwardly and forwardly and rearwardly beyond the core member. The front and the rear and the at least one middle projections are preferably extended upwardly beyond the core member and flush with each other.

The front projection is extended forwardly beyond the front portion of the core member, and the rear projection is extended rearwardly beyond the rear portion of the core member. The middle projection includes a width (w) no less than that of the rear projection.

The front and the rear and the at least one middle projections include a depth (d) equal to each other. The spaces between the front and the rear and the at least one middle projections include a gap distance (g) equal to each other.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
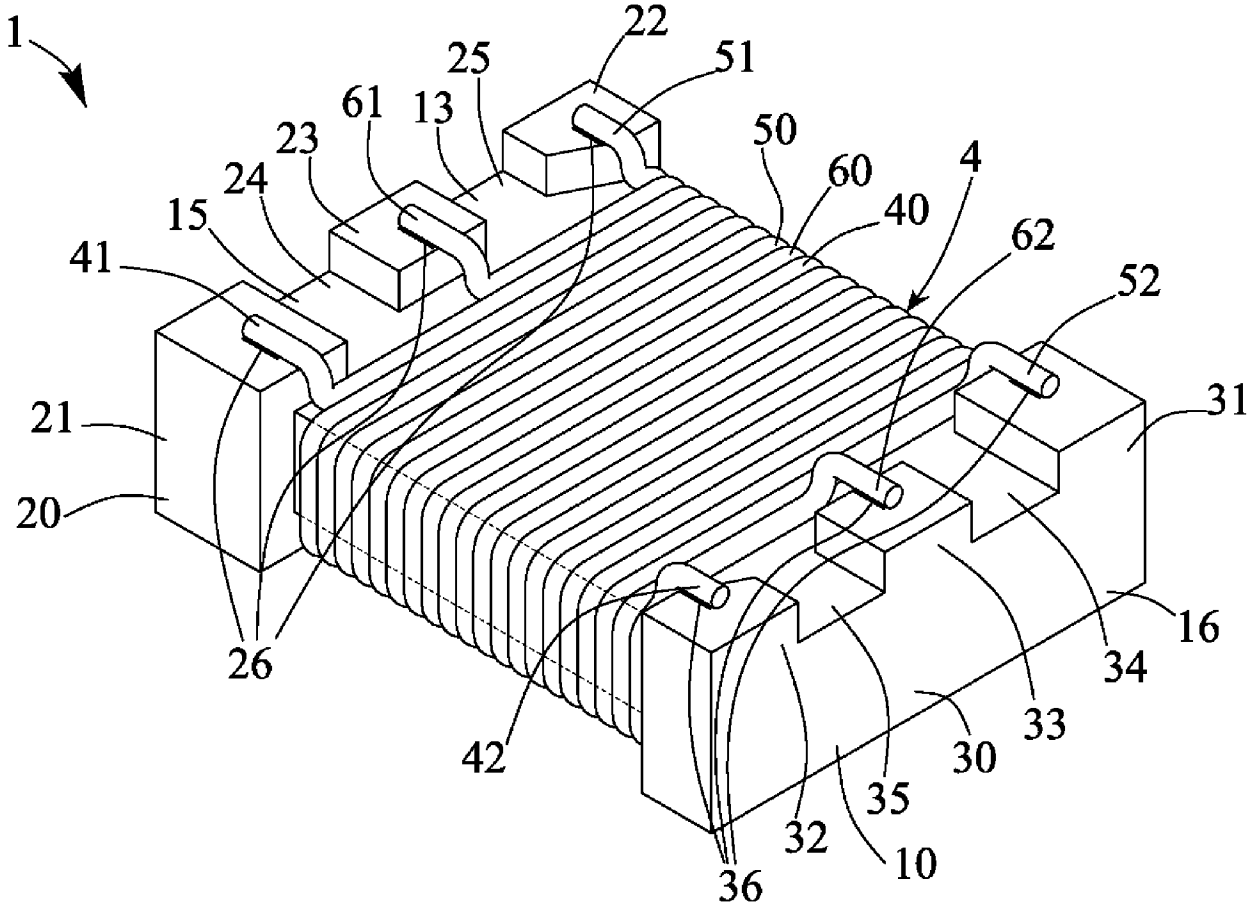
FIG. 1 is a perspective view of a coil filter in accordance with the present invention.
Figure 2:
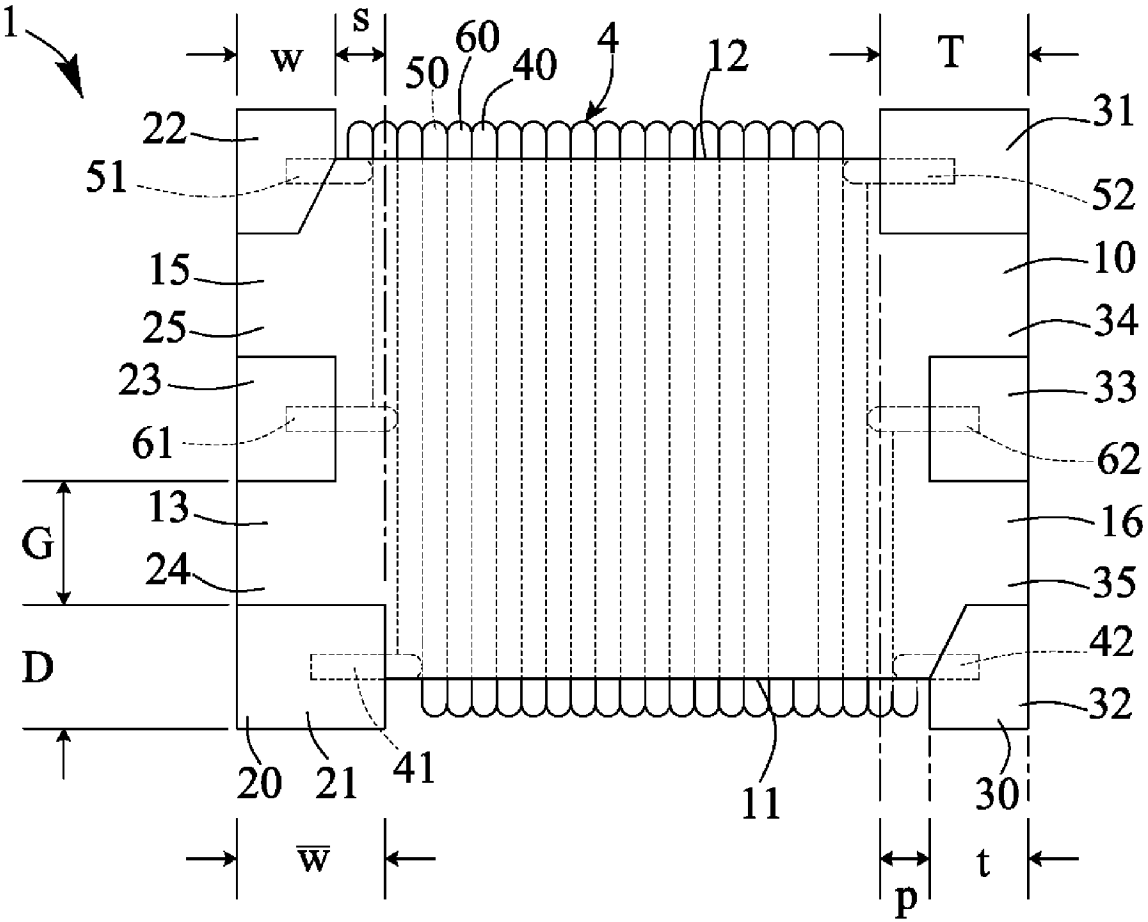
FIG. 2 is a top plan schematic view of the coil filter.
Figure 3:
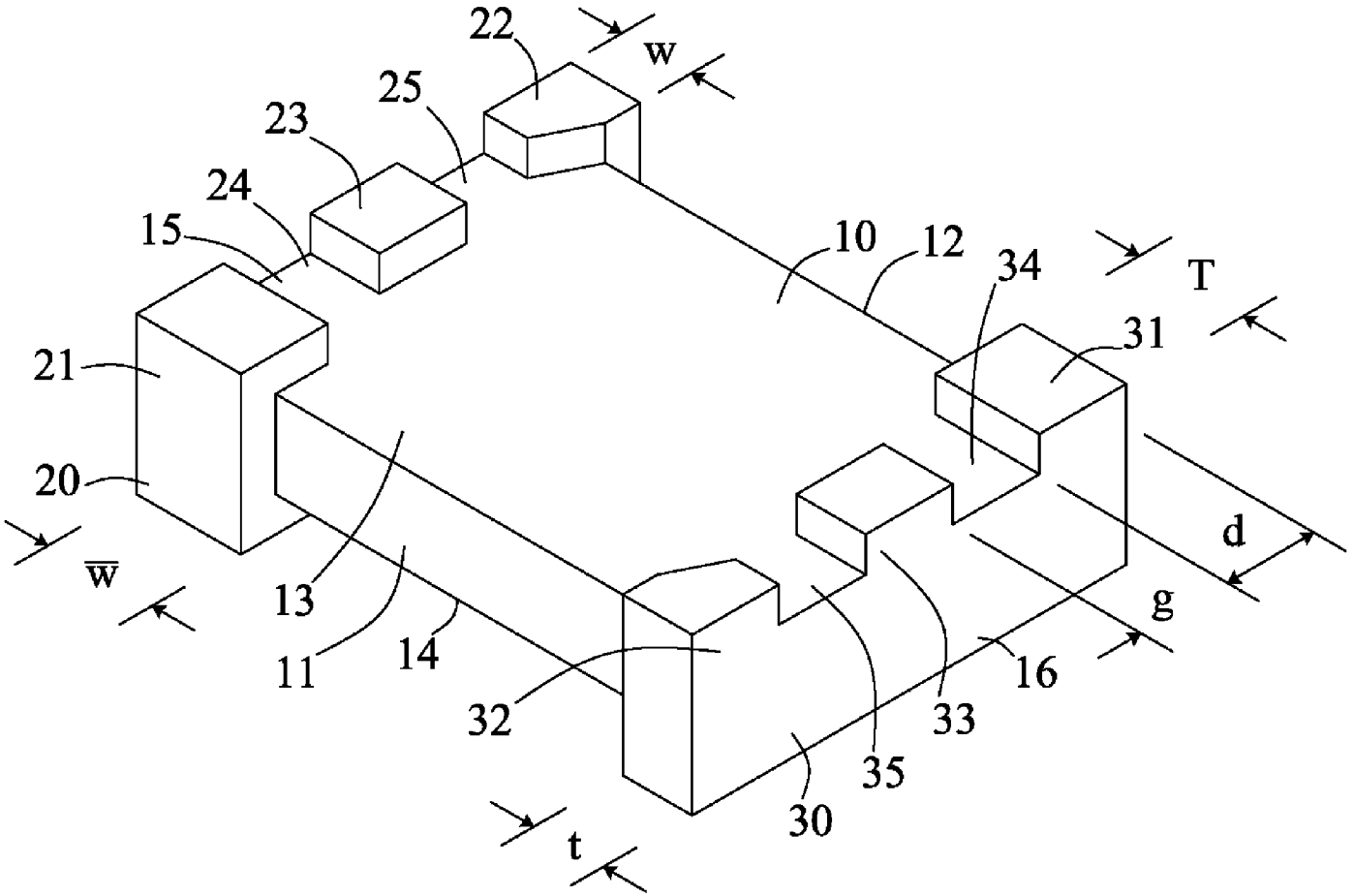
FIG. 3 is a perspective view illustrating a core member of the coil filter.

Referring to the drawings, and initially to FIGS. 1-3, a coil filter 1 in accordance with the present invention comprises a core member 10 including a front portion 11, a rear portion 12, an upper portion 13, a bottom portion 14, a left or one or first end portion 15, and a right or another or second end portion 16, and including a left or first fence or wall or end plate or end member 20 attached or mounted or secured to or extended from the left or one of the end portions 15 and preferably extended upwardly and downwardly and forwardly and rearwardly beyond the core member 10, and including another or right or second fence or wall or end plate or end member 30 attached or mounted or secured to or extended from the right or the other end portion 16 and preferably extended upwardly and downwardly and forwardly and rearwardly beyond the core member 10.

The left or first end member 20 includes a front or first protrusion 21 located at the front portion 11 of the core member 10, a rear or second protrusion 22 located at the rear portion 12 of the core member 10, and at least one middle or intermediate protrusion 23 formed or provided therein and located between the protrusions 21, 22 and extended upwardly beyond the core member 10 and flush with the protrusions 21, 22, for forming or defining two spaces or notches 24, 25 between the protrusions 21-23. The front or first protrusion 21 is extended forwardly beyond the front portion 11 of the core member 10, and the rear or second protrusion 22 is extended rearwardly beyond the rear portion 12 of the core member 10. It is preferable, but not necessary that the protrusions 21-23 include a length or depth (D) equal to each other, and the gap distance (G) of the notches 24, 25 or between the protrusions 21-23 are also equal to each other. The front or first protrusion 21 includes a length or width (W) greater than the length or width (w) of the rear or second protrusion 22 and the middle or intermediate protrusion 23, and the length or width (w) of the middle or intermediate protrusion 23 is equal to or greater than or no less than the length or width (w) of the rear or second protrusion 22; i.e., the length or width (w) of the rear or second protrusion 22 is equal to or smaller than or no greater than the length or width (w) of the middle or intermediate protrusion 23.

The right or second end member 30 includes a rear or first projection 31 located at the rear portion 12 of the core member 10, a front or second projection 32 located at the front portion 11 of the core member 10, and at least one middle or intermediate projection 33 formed or provided therein and located between the projections 31, 32 and extended upwardly beyond the core member 10 and flush with the projections 31, 32, for forming or defining two notches or spaces 34, 35 between the projections 31-33. The rear or first projection 31 is extended rearwardly beyond the rear portion 12 of the core member 10, and the front or second projection 32 is extended forwardly beyond the front portion 11 of the core member 10. It is preferable, but not necessary that the projections 31-33 include a length or depth (d) equal to each other, and the gap distance (g) of the spaces 34, 35 or between the projections 31-33 are also equal to each other. The rear or first projection 31 includes a length or width (T) greater than the length or width (t) of the front or second projection 32 and the middle or intermediate projection 33, and the length or width (t) of the middle or intermediate projection 33 is equal to or greater than or no less than the length or width (t) of the front or second projection 32; i.e., the length or width (t) of the front or second projection 32 is equal to or smaller than or no greater than the length or width (t) of the middle or intermediate projection 33.

The coil filter 1 further comprises a coil device or member 4 including three or more windings 40, 50, 60, such as a first winding 40, a second winding 50, and at least one third or middle or intermediate winding 60 disposed and arranged side by side and wound and engaged onto the core member 10, and disposed and arranged or located between the end members 20, 30, in which the third winding 60 is disposed located between the other two windings 40, 50. The first winding 40 includes two ends or terminals 41, 42 attached or mounted or engaged onto or secured to the front or first protrusion 21 and the front or second projection 32 with latches or fasteners or adhesive materials or welders 26, 36, or the like respectively, and the two ends or terminals 51, 52 of the second winding 50 are attached or mounted or engaged onto or secured to the rear or second protrusion 22 and the rear or first projection 31 with latches or fasteners or adhesive materials or welders 26, 36, or the like respectively, and the two ends or terminals 61, 62 of the third winding 60 are attached or mounted or engaged onto or secured to the middle or intermediate protrusion 23 and projection 33 with latches or fasteners or adhesive materials or welders 26, 36, or the like respectively.

As best shown in FIG. 2, the width (W) of the front or first protrusion 21 is greater than the length or width (w) of the rear or second protrusion 22 and the middle or intermediate protrusion 23, such that the space (s) between the front or first protrusion 21 and the rear or second protrusion 22 and the middle or intermediate protrusion 23 allows the windings 40, 50, 60 to be suitably wound and engaged onto the core member 10 without wasting the areas or spaces of the core member 10; and the width (T) of the rear or first projection 31 is greater than the length or width (t) of the front or second projection 32 and the middle or intermediate projection 33, such that the space (p) between the rear or first projection 31 and the front or second projection 32 and the middle or intermediate projection 33 allows the windings 40, 50, 60 to be suitably wound and engaged onto the core member 10 without wasting the areas or spaces of the core member 10.

Figure 4:
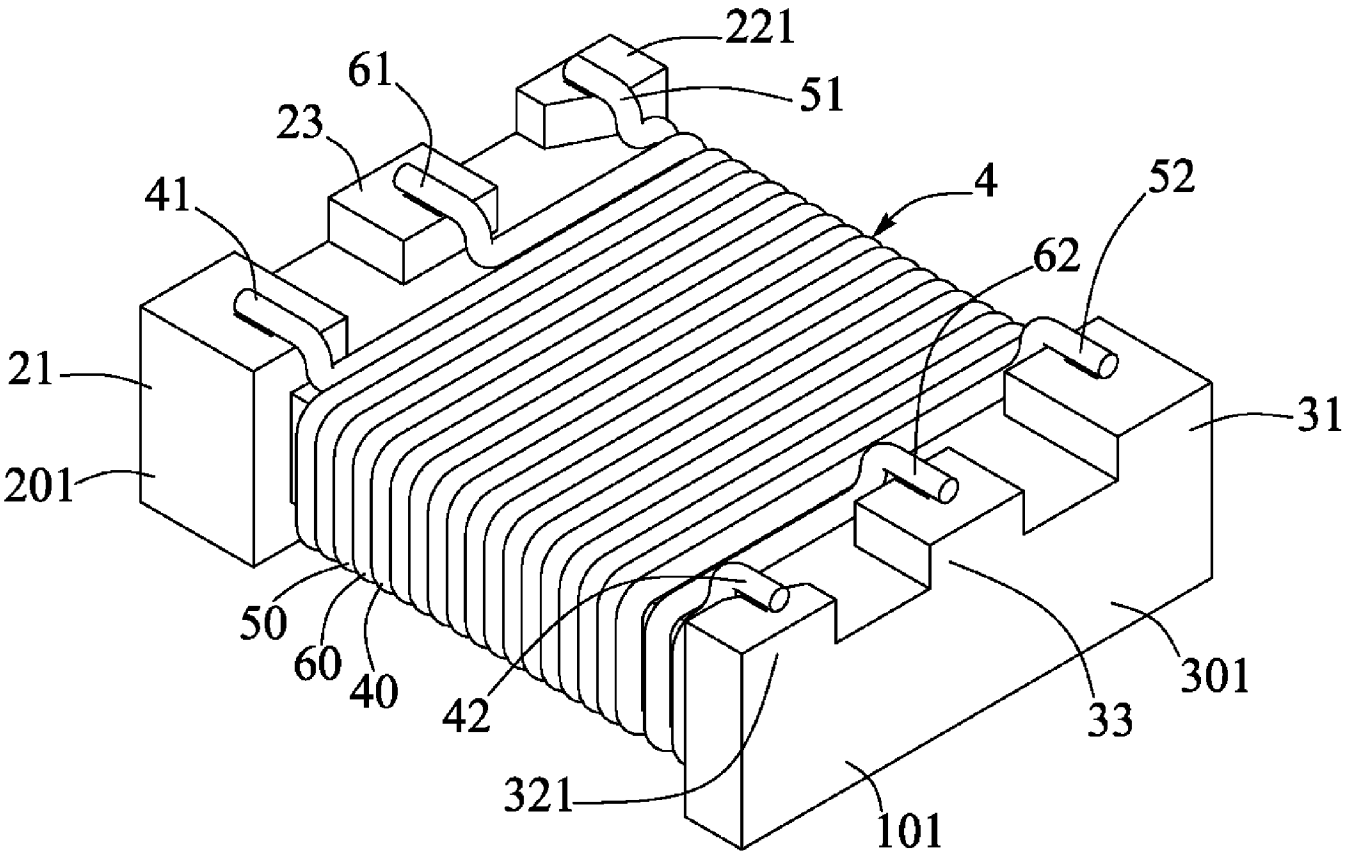
FIG. 4 is a perspective view similar to FIG. 1, illustrating the other arrangement of the coil filter.
Figure 5:
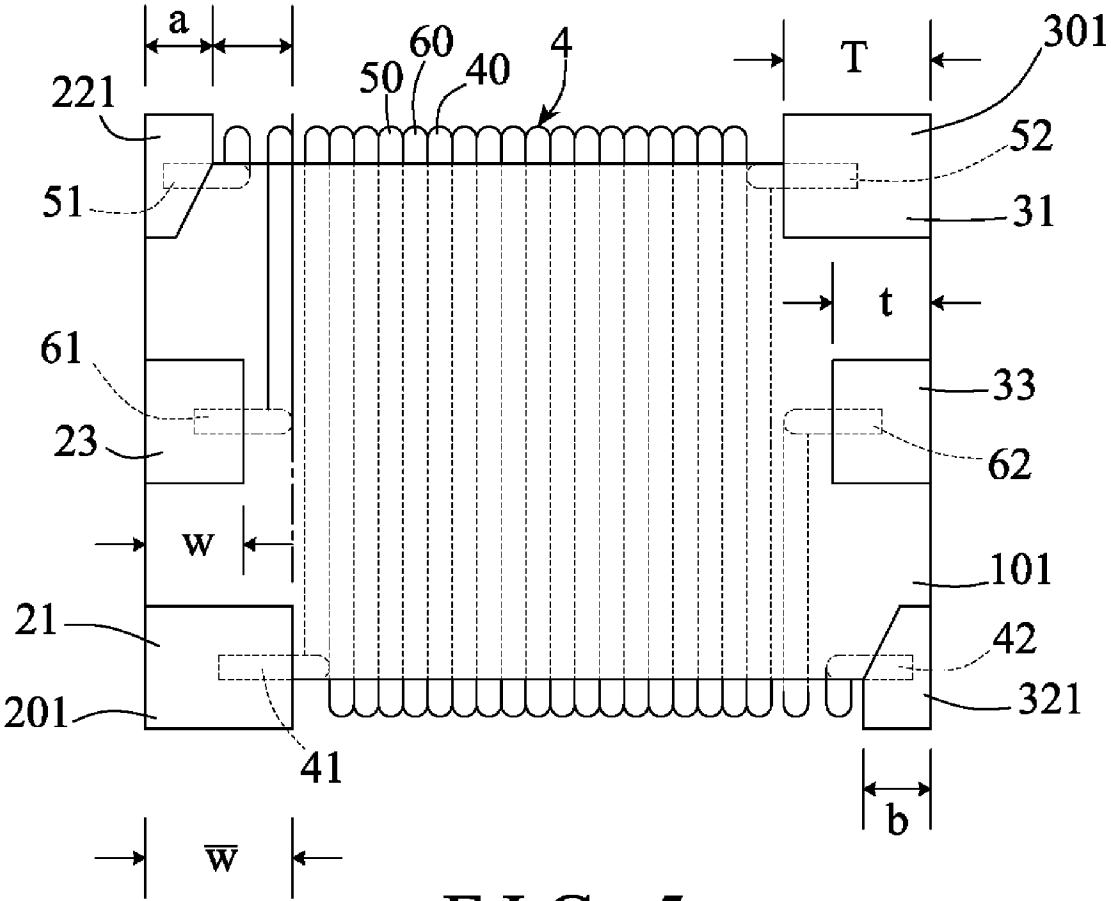
FIG. 5 is a top plan schematic view of the coil filter as shown in FIG. 4.

Alternatively, as shown in FIGS. 4 and 5, the rear or second protrusion 221 of the left or first end member 201 of the core member 101 includes a length or width (a) smaller than the length or width (w) of the middle or intermediate protrusion 23 which is smaller than the length or width (W) of the front or first protrusion 21, and the length or width (b) of the front or second projection 321 of the right or second end member 301 is smaller than the length or width (t) of the middle or intermediate projection 33 which is smaller than the length or width (T) of the rear or first projection 31, and also arranged for allowing the windings 40, 50, 60 of the coil member 4 to be suitably wound and engaged and secured onto the core member 101 without wasting the areas or spaces of the core member 101.

In operation, as shown in FIGS. 1 and 2, the windings 40, 50, 60 of the coil member 4 are disposed and arranged side by side and disposed and arranged or located between the end members 20, 30, and may be suitably and compactly wound and engaged onto the core member 10, in addition, the space (s) between the front or first protrusion 21 and the rear or second protrusion 22 and the middle or intermediate protrusion 23, and the space (p) between the rear or first projection 31 and the front or second projection 32 and the middle or intermediate projection 33 allows the windings 40, 50, 60 of the coil member 4 to be suitably wound and engaged onto the core member 10 without wasting the areas or spaces of the core member 10.

Accordingly, the coil filter in accordance with the present invention includes a core member having an improved structure or configuration for allowing the windings of the coil member to be suitably wound and engaged onto the core member without wasting the spaces of the core member.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A coil filter comprising:

a core member including a front portion, a rear portion, an upper portion, a bottom portion, a first end portion, and a second end portion, and including a first end member extended from said first end portion of said core member, and including a second end member extended from said second end portion of said core member, said first end member including a front protrusion located at said front portion of said core member, a rear protrusion located at said rear portion of said core member, and at least one middle protrusion extended upwardly beyond said core member and located between said front and said rear protrusions for forming two notches between said front and said rear and said at least one middle protrusions, said front protrusion including a width (W) greater than that of said rear protrusion and said at least one middle protrusion, said second end member including a rear projection located at said rear portion of said core member, a front projection located at said front portion of said core member, and at least one middle projection extended upwardly beyond said core member and located between said front and said rear projections for forming two spaces between said front and said rear and said at least one middle projections, said rear projection including a width (T) greater than said width (t) of said front projection and said middle projection, and a coil member wound and engaged onto said core member and disposed and arranged between said first and said second end members.

2. The coil filter as claimed in claim 1, wherein said coil member includes a first winding wound and engaged onto said core member, and said first winding includes two terminals engaged onto said front protrusion and said front projection respectively.

3. The coil filter as claimed in claim 2, wherein said terminals of said first winding are secured to said front protrusion and said front projection with welders respectively.

4. The coil filter as claimed in claim 2, wherein said coil member includes a second winding wound and engaged onto said core member, and said second winding includes two terminals engaged onto said rear protrusion and said rear projection respectively.

5. The coil filter as claimed in claim 4, wherein said terminals of said second winding are secured to said rear protrusion and said rear projection with welders respectively.

6. The coil filter as claimed in claim 4, wherein said coil member includes at least one third winding wound and engaged onto said core member and disposed between said first and said second windings, said at least one third winding includes two terminals engaged onto said at least one middle protrusion and said at least one middle projection respectively.

7. The coil filter as claimed in claim 6, wherein said terminals of said at least one third winding are secured to said at least one middle protrusion and said at least one middle projection with welders respectively.

8. The coil filter as claimed in claim 1, wherein said first end member is extended upwardly and downwardly and forwardly and rearwardly beyond said core member.

9. The coil filter as claimed in claim 1, wherein said front and said rear and said at least one middle protrusions are extended upwardly beyond said core member and flush with each other.

10. The coil filter as claimed in claim 1, wherein said front protrusion is extended forwardly beyond said front portion of said core member, and said rear protrusion is extended rearwardly beyond said rear portion of said core member.

11. The coil filter as claimed in claim 1, wherein said at least one middle protrusion includes a width (w) no less than that of said rear protrusion.

12. The coil filter as claimed in claim 1, wherein said front and said rear and said at least one middle protrusions include a depth (D) equal to each other.

13. The coil filter as claimed in claim 1, wherein said notches between said front and said rear and said at least one middle protrusions include a gap distance (G) equal to each other.

14. The coil filter as claimed in claim 1, wherein said second end member is extended upwardly and downwardly and forwardly and rearwardly beyond said core member.

15. The coil filter as claimed in claim 1, wherein said front and said rear and said at least one middle projections are extended upwardly beyond said core member and flush with each other.

16. The coil filter as claimed in claim 1, wherein said front projection is extended forwardly beyond said front portion of said core member, and said rear projection is extended rearwardly beyond said rear portion of said core member.

17. The coil filter as claimed in claim 1, wherein said at least one middle projection includes a width (w) no less than that of said rear projection.

18. The coil filter as claimed in claim 1, wherein said front and said rear and said at least one middle projections include a depth (d) equal to each other.

19. The coil filter as claimed in claim 1, wherein said spaces between said front and said rear and said at least one middle projections include a gap distance (g) equal to each other.

* * * * *